US008136914B2

(12) United States Patent
Inoue et al.

(10) Patent No.: US 8,136,914 B2
(45) **Date of Patent: *Mar. 20, 2012**

(54) IMAGE RECORDING METHOD AND IMAGE RECORDING APPARATUS

(75) Inventors: Yoshiaki Inoue, Kanagawa (JP); Toru Shimizu, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 460 days.

This patent is subject to a terminal disclaimer.

(21) Appl. No.: 12/414,091

(22) Filed: Mar. 30, 2009

(65) Prior Publication Data

US 2009/0244150 A1 Oct. 1, 2009

(30) Foreign Application Priority Data

Mar. 31, 2008 (JP) ..... 2008-094324

(51) Int. Cl.
*B41J 29/393* (2006.01)

(52) U.S. Cl. ..... 347/19; 347/14

(58) Field of Classification Search ..... 347/14, 347/15, 19

See application file for complete search history.

(56) References Cited

U.S. PATENT DOCUMENTS

| | | | | |
|---|---|---|---|---|
| 5,189,521 | A * | 2/1993 | Ohtsubo et al. | 358/296 |
| 5,276,459 | A * | 1/1994 | Danzuka et al. | 346/33 A |
| 5,596,353 | A | 1/1997 | Takada et al. | |
| 6,149,264 | A * | 11/2000 | Hirabayashi et al. | 347/43 |
| 6,283,570 | B1 * | 9/2001 | Komiya et al. | 347/15 |
| 7,367,644 | B2 * | 5/2008 | Arazaki et al. | 347/15 |
| 7,484,824 | B2 | 2/2009 | Chiwata | |
| 2005/0168562 | A1 * | 8/2005 | Imai | 347/188 |
| 2006/0214960 | A1 * | 9/2006 | Chiwata | 347/10 |
| 2009/0225121 | A1 * | 9/2009 | Miyamoto | 347/15 |
| 2010/0165022 | A1 * | 7/2010 | Makuta et al. | 347/9 |

FOREIGN PATENT DOCUMENTS

| | | | |
|---|---|---|---|
| EP | 0452157 | A1 * | 10/1991 |
| JP | 4-18356 | A | 1/1992 |
| JP | 2006-264069 | A | 10/2006 |
| JP | 2006-347164 | A | 12/2006 |

* cited by examiner

*Primary Examiner* — Charlie Peng
(74) *Attorney, Agent, or Firm* — Birch, Stewart, Kolasch & Birch, LLP

(57) ABSTRACT

An image recording method comprises the steps of: acquiring first recording characteristic information of recording elements of a recording head by reading a first test pattern formed with ejecting ink droplet from the recording elements; obtaining first density unevenness correction information based on the first recording characteristic information; acquiring second recording characteristic information of the recording element by reading a second test pattern different from the first test pattern formed with ejecting ink droplet from the recording elements; obtaining second density unevenness correction information based on the second recording characteristic information; correcting image data based on the first and second density unevenness correction information to calculate density unevenness-corrected image data; and calculating an ejection pattern of the recording element based on the unevenness-corrected image data.

14 Claims, 9 Drawing Sheets

IMAGE RECORDING METHOD AND IMAGE RECORDING APPARATUS

The entire contents of all documents cited in this specification are incorporated herein by reference.

BACKGROUND OF THE INVENTION

The present invention relates to an image recording method and an image recording apparatus, each for recording an image on a recording medium by ejecting ink droplets from an inkjet head.

As a method of recording an image on a recording medium, there is provided an inkjet recording method in which ink droplets are ejected from an inkjet head to form an image.

The inkjet recording method has a problem in that, because ink droplets are ejected from a plurality of ejection ports, variation in ejection characteristic of each recording element provided with the ejection port causes density unevenness in a recorded image. This problem is particularly conspicuous in a case of a single-pass type inkjet method in which, with a line-type inkjet head being fixed, a recording medium is conveyed once in one direction, whereby an image is recorded on the entire surface of the recording medium.

As a method of correcting the density unevenness, there are provided a method in which the density unevenness is corrected by changing, for each recording element, an ejection driving condition in accordance with the density unevenness and adjusting the dot diameter or the dot density, and a method which eliminates the influence of the density unevenness on a recorded image by correcting image data in accordance with the density unevenness.

The correction method by changing the ejection driving condition is such a method that makes a change with respect to the ink droplets to be ejected from an inkjet head, and hence, at the time of implementation, there exists a limitation on the driving method of the inkjet head and the correction range. On the other hand, the method by correcting the image data in accordance with the density unevenness can be implemented by correcting data without changing the actual ink droplets to be ejected from the inkjet head, that is, without changing the inkjet head itself (that is, without physical change thereof). Therefore, this method has greater flexibility, and various types of such correction methods have been proposed.

Here, in the case of converting image data, γ conversion is performed for each recording element with the use of a 1D-LUT.

As a method for obtaining a correction curve (unevenness correction coefficient) of the 1D-LUT, there are proposed a method in which, as in JP 04-18356 A, the density of an area corresponding to the position of a recording element is measured to thereby correct the density unevenness of a print area, and a method in which, as in JP 2006-264069 A and JP 2006-347164 A, the accuracy of the position of a droplet ejected from a recording element is measured with high precision, and a correction coefficient is calculated based on the positional information.

Here, JP 04-18356 A describes a method in which ink droplets are ejected from all the recording elements to create, on a recording medium, a solid image having a given density (for example, density of 50%), and, based on density variation of the image, the density unevenness is calculated and then corrected. Further, JP 04-18356 A also describes creating, by calculating only the amount of change from the last density unevenness correction data, correction data in a shorter period of time compared to creating correction data again from the beginning.

Further, JP 2006-264069 A gives a description as follows. Ink droplets are ejected from each ejection nozzle to form a test pattern, in which lines are made by the respective ejection nozzles. After the test pattern is read, based on a density profile of each line included in the read test pattern, a landing position error of the ink droplets ejected from each nozzle is detected, and, based on the landing position error, the density unevenness is corrected. Further, in JP 2006-264069 A, there is a description that, at the time of detection of the landing position error, the error characteristic of an ejection amount from a nozzle may be detected.

Further, in JP 2006-347164 A, there is a description that, based on the detected landing position of an ink droplet, a correction coefficient is calculated.

Here, to attain high-precision print quality, a pixel density of, for example, 1,200 dpi or higher is required as the pixel density of the inkjet head. Accordingly, one droplet (impact point) becomes smaller, and hence an interval error between the impact points becomes extremely small as well.

Further, the method of measuring the image density of an area corresponding to the droplet landing position of each recording element, which is described in JP 04-18356 A, requires a resolution at least twice as high as the resolution of the image so that the correspondence between the position of the recording element and the measurement in the relevant area can be obtained with high precision.

Accordingly, in a case where the method described in JP 04-18356 A is used for correcting density unevenness of a high-pixel-density image as described above, a resolution of 2,400 dpi or higher is required. As a result, it takes an extremely long period of time to perform scanning, measurement data transfer, and measurement data processing.

Incidentally, with regard to the method in which the area density is measured, it is known that even such a method, in which reading during the measurement is performed in a low resolution so as to reduce the required period of time, and then the density of each recording element area is estimated, has the effect of correcting unevenness. However, if a scanning resolution is made lower, the effect of unevenness correction becomes insufficient for unevenness having high-frequency components higher than the scanning resolution.

In addition, the method described in JP 04-18356 A has a problem in that sufficient precision cannot be attained by performing the unevenness correction once.

Further, when used for the density unevenness correction of a high-pixel density image as described above, the methods described in JP 2006-264069 A and JP 2006-347164 A, too, require a resolution of 2,400 dpi or higher in order to measure a dot position with high precision, and have a problem in that it takes an extremely long period of time to perform the scanning, the measurement data transfer, and the measurement data processing.

Particularly, a method in which a dot position and a dot diameter are detected based on the density profile as in the method described in JP 2006-264069 A requires particularly high-precision measurement due to the need to calculate the outer shape and density of a dot accurately. Besides, there is a problem in that, because the calculation is performed for each recording element, the calculation amount becomes larger, and it takes a longer period of time for the data processing.

Further, with this method, another problem is that, in some cases, low-frequency unevenness is not sufficiently eliminated depending on the type of position error.

SUMMARY OF THE INVENTION

An object of the present invention is to provide an image recording method and an image recording apparatus which are capable of, by solving the problems inherent in the above-mentioned prior art, detecting density unevenness efficiently in an appropriate manner, carrying out correction processing based on the detected density unevenness, and recording an image in which the density unevenness has been corrected.

An image recording method according to the present invention comprises: a first recording characteristic information acquiring step of causing each of recording elements of a recording head to eject ink droplet, forming a first test pattern on a recording medium, reading the formed first test pattern, and acquiring first recording characteristic information of the recording element based on a result of the reading; a first density unevenness correction information calculating step of obtaining first density unevenness correction information based on the first recording characteristic information; a second recording characteristic information acquiring step of causing the each of the recording elements of the recording head to eject the ink droplet, forming a second test pattern different from the first test pattern on the recording medium, reading the second test pattern, and acquiring second recording characteristic information of the recording element based on a result of the reading; a second density unevenness correction information calculating step of obtaining second density unevenness correction information based on the second recording characteristic information; a third density unevenness correction information calculating step of obtaining third density unevenness correction information based on the first density unevenness correction information and the second density unevenness correction information; a density correction processing step of correcting image data based on the third density unevenness correction information to calculate density unevenness-corrected image data; and an ejection control signal calculating step of calculating an ejection pattern of the recording element based on the unevenness-corrected image data.

An image recording apparatus according to the present invention comprises: a recording head comprising a plurality of recording elements for ejecting an ink droplet toward a recording medium; movement means that causes the recording head and the recording medium to move relative to each other; recording operation control means that records an image on the recording medium by causing the recording head to eject the ink droplet toward the recording medium while the recording head and the recording medium are moved relative to each other; first test pattern reading means that reads a first test pattern formed on the recording medium by ejecting the ink droplet from each of the plurality of recording elements of the recording head; first recording characteristic information acquiring means that acquires first recording characteristic information of the each of the plurality of recording elements based on a result of the reading of the first test pattern; first density unevenness correction information calculating means that obtains first density unevenness correction information based on the first recording characteristic information; second test pattern reading means that reads a second test pattern different from the first test pattern, which is formed on the recording medium by ejecting the ink droplet from the each of the plurality of recording elements of the recording head; second recording characteristic information acquiring means that acquires second recording characteristic information of the each of the plurality of recording elements based on a result of the reading of the second test pattern; second density unevenness correction information calculating means that obtains second density unevenness correction information based on the second recording characteristic information; third density unevenness correction information calculating means that obtains third density unevenness correction information based on the first density unevenness correction information and the second density unevenness correction information; density correction processing means that corrects image data based on the third density unevenness correction information to calculate density unevenness-corrected image data; and ejection pattern calculating means that calculates an ejection pattern of the each of the plurality of recording elements based on the unevenness-corrected image data.

DETAILED DESCRIPTION OF THE INVENTION

An image recording method and an image recording apparatus according to the present invention are described in detail with reference to an embodiment thereof as illustrated in the accompanying drawings.

Figure 1:
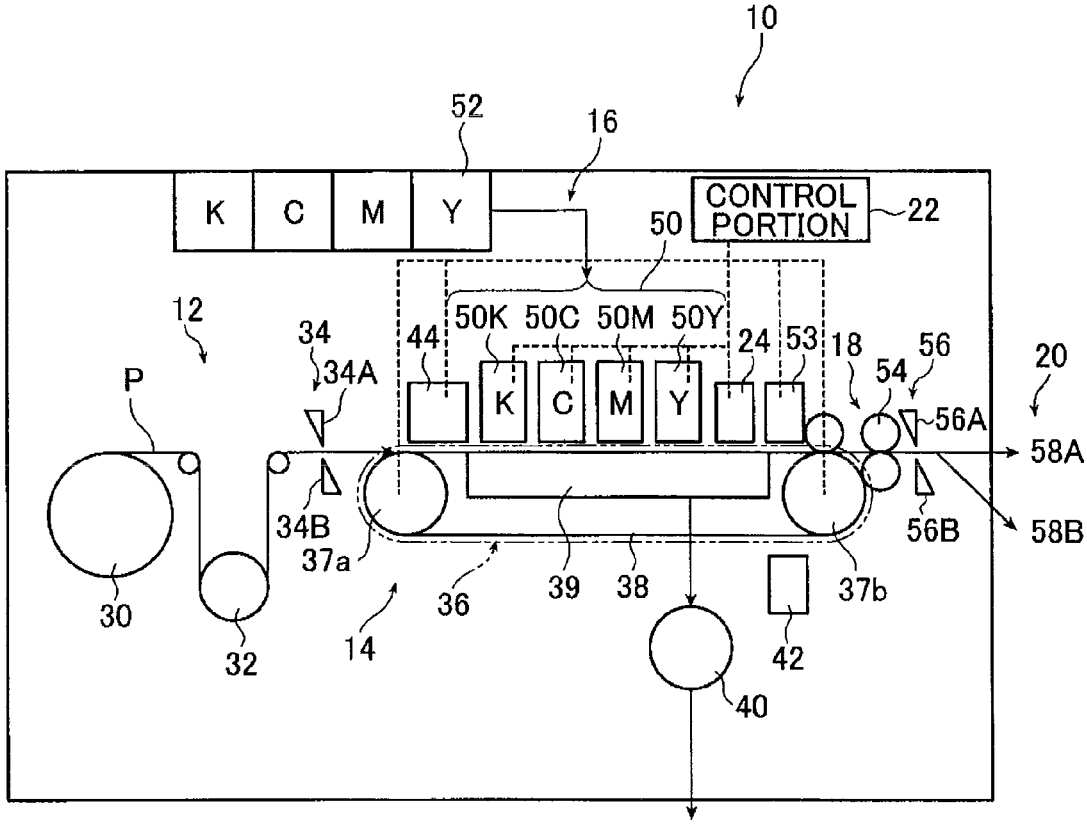
FIG. 1 is a front view illustrating a schematic configuration of an image recording apparatus.
Figure 2:
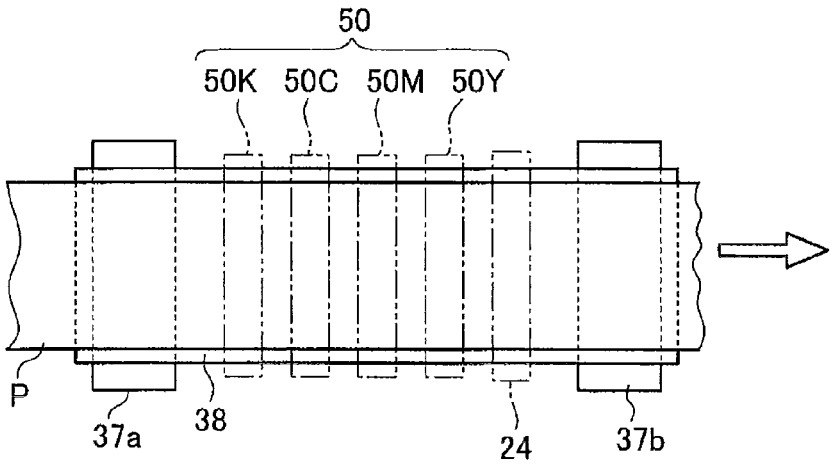
FIG. 2 is a top view illustrating a conveying attraction belt and a recording head unit of the image recording apparatus illustrated in FIG. 1.

FIG. 1 is a front view illustrating a schematic configuration of an image recording apparatus 10 as an embodiment of the image recording apparatus of the present invention, which employs the image recording method of the present invention. FIG. 2 is a top view illustrating an attraction belt conveying portion 36 and a recording head unit 50 of the image recording apparatus 10 illustrated in FIG. 1.

The image recording apparatus 10 fundamentally includes a feeding portion 12 for feeding a recording medium P, a conveying portion 14 for conveying the recording medium P fed by the feeding portion 12 in a manner to keep its flatness, a drawing portion 16 which is placed opposite to the conveying portion 14 and includes a recording head unit 50 for drawing an image on the recording medium P and an ink storage/filling portion 52 for storing ink to be fed to the recording head unit 50, a heat-pressing portion 18 for heating and pressing the recording medium P on which the image has been drawn, a discharging portion 20 for discharging to the outside the recording medium P on which the image has been drawn, a scanner 24 for reading the image recorded on the recording medium P by the drawing portion 16, and a control portion 22 for controlling those components.

The feeding portion 12 includes a magazine 30, a heating drum 32, and a cutter 34.

The magazine 30 stores the recording medium P in a rolled form. At the time of image drawing, the recording medium P is fed to the heating drum 32 from the magazine 30.

The heating drum 32 is placed downstream of the magazine 30 along the conveying path of the recording medium P, and heats the recording medium P delivered from the magazine 30 in a state in which the recording medium P is bent in a direction opposite to the direction in which the recording medium P is bent during the storage in the magazine 30.

Through heating by the heating drum 32, the recording medium P, which has become curled while stored in the magazine 30, is straightened. In other words, the heating drum 32 performs decurling processing for the recording medium P.

At this point, desirably, the heating temperature is so controlled that the recording medium P is slightly curled toward the printed side thereof.

The cutter 34 includes a fixed blade 34A having a length larger than the width of the conveying path of the recording medium P and a round blade 34B which moves along the fixed blade 34A. The fixed blade 34A is placed on the side of the conveying path, on which an image is to be drawn on the surface of the recording medium P, and the round blade 34B is placed on the opposite side of the conveying path.

The cutter 34 cuts the recording medium P fed through the heating drum 32 into a desired size.

Here, in this embodiment, the feeding portion 12 is provided with one magazine, but the present invention is not limited thereto. For example, a plurality of magazines storing various recording media different in paper width, paper quality, or type may be provided. Moreover, instead of the magazine, or in addition to the magazine, it is possible to employ a cassette containing a stack of cut sheets provided by cutting a web of recording medium into a predetermined length. In a case where only the recording medium previously cut into sheets of a predetermined length is used as the recording medium P, the above-mentioned heating roller and cutter do not necessarily have to be provided.

Further, in a case of a configuration in which a plurality of types of recording sheets are made available for use by employing a plurality of magazines and/or cassettes, it is desirable that ink ejection control be performed in the following manner. An information-recorded member such as a bar code or a wireless tag, on which information on paper type is recorded, is attached to each of the magazines and/or cassettes, and, by reading the information of the information-recorded member by a given reading device, the type of a sheet to be used is automatically determined to realize appropriate ink ejection in accordance with the type of the sheet.

The conveying portion 14 includes the attraction belt conveying portion 36, an attraction chamber 39, a fan 40, a belt cleaning portion 42, and a heating fan 44. The conveying portion 14 conveys the recording medium P, which has been subjected to the decurling processing and cut into a predetermined length in the feeding portion 12, to a drawing position, that is, a position at which an image is drawn by the drawing portion 16 described below.

The attraction belt conveying portion 36 is placed downstream of the cutter 34 along the conveying path of the recording medium P, and includes a roller 37*a*, a roller 37*b*, and a belt 38.

The belt 38 is an endless belt having a width larger than the width of the recording medium P, and is extended between the roller 37*a* and the roller 37*b* under tension. Further, the belt 38 has numerous suction holes (not shown) formed in the plane body thereof.

Further, the attraction belt conveying portion 36 is kept flat at least at an image drawing (printing) position, that is, in its part opposed to a nozzle surface of the recording head unit 50 (described below) of the drawing portion 16, and at an image detection position, that is, in its part opposed to a sensor surface of the scanner (described below), relative to the nozzle surface and the sensor surface.

At least one of the roller 37*a* and the roller 37*b*, on which the belt 38 is mounted, is connected to a motor (not shown), and the power of the motor is transmitted to the belt 38 via at least one of the roller 37*a* and the roller 37*b*. As a result, the belt 38 is driven in a clockwise direction in FIG. 1, whereby the recording medium P held on the belt 38 is conveyed from the left to the right in FIG. 1.

Here, conveying means for the recording medium P is not limited in particular, and, instead of the attraction belt conveying portion 36, a roller nip conveyance mechanism can be employed. However, in the case of the roller nip conveyance employed in a drawing area, there is a problem in that the image easily becomes smeared because the printed surface of a sheet and the roller come into contact immediately after printing. Hence, in a printing area, such attraction belt conveyance as in this embodiment is desirable because nothing comes into contact with an image surface.

The attraction chamber 39 is provided on the inner side of the belt 38 at a position opposed to the nozzle surface of the recording head unit 50 (described below) of the drawing portion 16 and the sensor surface of the scanner 24. Further, the fan 40 is connected to the attraction chamber 39. A negative pressure is created in the attraction chamber 39 by the suction through the fan 40, whereby the recording medium P on the belt 38 is held on the belt 38 in an attracted manner.

By attracting the recording medium P to the belt 38, the recording medium P can be stably held.

The belt cleaning portion 42 is placed on the outer side of the belt 38, that is, opposite to the outer circumferential surface of the ring-shaped belt, and is spaced apart from the conveying path of the recording medium P. Specifically, the belt 38 passes through the drawing portion 16, and after discharging the recording medium P to a pressure roller pair 54 described below, passes through a position opposed to the belt cleaning portion 42.

The belt cleaning portion 42 removes ink which has been attached on the belt 38 due to borderless printing or the like.

For the belt cleaning portion 42, for example, a method of performing nipping with a brush roll, a water absorption roll, or the like, an air-blow method in which cleaning air is blown against the belt, or a combination thereof may be employed. In the case of nipping with a cleaning roll, a larger cleaning effect can be attained by making the belt linear speed and the roller linear speed different from each other.

The heating fan 44 is placed on the outer side of the belt 38, and upstream of the recording head unit 50 (described below) of the drawing portion 16 along the conveying path of the recording medium P.

The heating fan 44 blows heated air onto the recording medium P before drawing to heat the recording medium P. If the recording medium P is heated immediately before drawing, the ink becomes easy to dry after landing.

The drawing portion 16 includes the recording head unit 50 for drawing (printing) an image, and the ink storage/filling portion 52 for supplying ink to the recording head unit 50.

The recording head unit 50 includes recording heads 50K, 50C, 50M, and 50Y, and is placed opposite to the surface of the belt 38, on which the recording medium P is placed.

The recording heads 50K, 50C, 50M, and 50Y are piezoelectric inkjet heads which eject black (K) ink, cyan (C) ink, magenta (M) ink, and yellow (Y) ink from ejection portions, respectively. The recording heads 50K, 50C, 50M, and 50Y, each opposed to the surface of the belt 38, on which the recording medium P is placed, are arranged downstream of the heating fan 44 in the conveying direction of the recording medium P in this order, with the head 50K being nearest the fan 44. Further, the recording heads 50K, 50C, 50M, and 50Y are connected to the ink storage/filling portion 52 and the control portion 22.

Further, as illustrated in FIG. 2, the recording heads 50K, 50C, 50M, and 50Y are each a full-line inkjet head in which a plurality of ejection portions (nozzles) are arranged in line over such a region whose width in a direction orthogonal to the conveying direction of the recording medium P exceeds the maximum width of the recording medium P to be conveyed. Here, the configuration of the inkjet head is described below in detail along with a relation thereof with the ink storage/filling portion 52.

With the full-line recording heads as in this embodiment, an image can be recorded on the entire surface of the recording medium P by moving once the recording medium P and the drawing portion 16 relative to each other (in other words, by one scan) in a direction orthogonal to the directions of ejection portion arrangement of the recording heads (auxiliary scanning direction). With this configuration, compared to the shuttle recording head in which a recording head runs back and forth in the main scanning direction, it is possible to perform high speed printing, which therefore leads to an improved productivity.

The ink storage/filling portion 52 includes ink supply tanks for storing color inks which correspond to the recording heads 50K, 50C, 50M, and 50Y, respectively.

For the ink supply tank, for example, a system in which the tank is replenished with ink from a replenishing inlet (not shown) when the remaining ink is scarce, or a cartridge system in which an almost empty tank is replaced with a new one can be employed.

The ink supply tanks of the ink storage/filling portion 52 are communicating with the recording heads 50K, 50C, 50M, and 50Y via tubes (not shown), respectively, so as to supply ink to the recording heads 50K, 50C, 50M, and 50Y.

Here, it is desirable that the ink storage/filling portion 52 be provided with notification means (display means, warning tone generation means, etc.) for making, when the remaining ink becomes scarce, a notification to that effect, and include a mechanism for preventing erroneous filling among colors.

Further, in a case where ink types are changed in accordance with the intended use, it is desirable that the cartridge system be used. In addition, it is desirable that, by identifying information on the ink type through a bar code or the like, such ejection control that corresponds to the ink type be performed.

Next, the configurations of the recording heads 50K, 50C, 50M, and 50Y are described. Here, the recording heads 50K, 50C, 50M, and 50Y have the same configuration except for the colors of ink to be ejected, and hence the recording head 50K is described as an example hereinbelow.

Figure 3A:
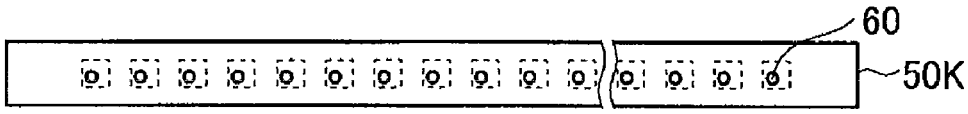
FIG. 3A is a front view illustrating an arrangement pattern of ejection portions of a recording head.
Figure 3B:
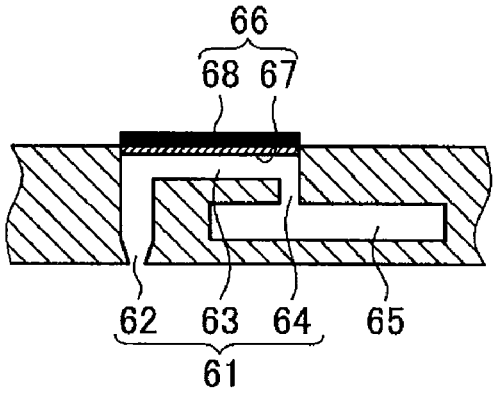
FIG. 3B is an enlarged cross-section illustrating one ejection portion of the recording head illustrated in FIG. 3A.

FIG. 3A is a front view illustrating an arrangement pattern of the ejection portions 60 of the recording head 50K, while FIG. 3B is an enlarged cross-section illustrating one ejection portion 60 of the recording head 50K.

As illustrated in FIG. 3A, the recording head 50K includes a plurality of recording elements (hereinbelow, referred to as "ejection portions") 60 which eject ink droplets. The ejection portions 60 are arranged in line at fixed intervals.

As illustrated in FIG. 3B, one ejection portion 60 includes an ink chamber unit 61 and an actuator 66. Further, the ink chamber unit 61 is connected to a common flow path 65. The common flow path 65 is connected to the ink chamber units 61 of all the ejection portions 60.

The ink chamber unit 61 includes a nozzle 62, a pressure chamber 63, and a supply opening 64.

The nozzle 62, which is an opening portion for ejecting ink droplets, has one end opened on a surface opposed to the recording medium P and the other end connected to the pressure chamber 63.

The pressure chamber 63 has a rectangular shape in which the planar shape of the faces perpendicular to the ejecting direction of ink droplets is substantially square, and two corner portions on a diagonal line are connected to the nozzle 62 and the supply opening 64, respectively.

The supply opening 64 has one end connected to the pressure chamber 63, and the other end communicating with the common flow path 65.

The actuator 66 is placed on the side (upper side) of the pressure chamber 63 opposite to the side on which the pressure chamber 63 is connected to the nozzle 62 and the supply opening 64, and includes a pressure plate 67 and a separate electrode 68.

In the actuator 66, a driving voltage is applied to the separate electrode 68 to thereby deform the pressure plate 67.

An ink ejection method of the ejection portion 60 is described.

Ink is supplied to the pressure chamber 63 and the nozzle 62 from the common flow path 65 via the supply opening 64.

In a state in which the pressure chamber 63 and the nozzle 62 are filled with ink, when a driving voltage is applied to the separate electrode 68, the pressure plate 67 is deformed to pressurize the pressure chamber 63, whereby the ink is ejected from the nozzle 62. By thus driving the actuator 66, ink droplets can be ejected from the nozzle 62.

Further, after the ink is ejected, new ink is supplied to the pressure chamber 63 from the common flow path 65 through the supply opening 64.

It should be noted that the structural arrangement of the ejection portion of the present invention is not limited to the illustrated example. Further, in this embodiment, there is adopted a method in which an ink droplet is ejected by deformation of the actuator 66 as typified by a piezo-electric element. However, the present invention is not limited thereto with regard to a method of ejecting ink, and, instead of a piezo-electric method, various kinds of methods may be employed, including a thermal inkjet method in which a heating element such as a heater heats ink to generate bubbles, and an ink droplet is ejected by the pressure of the bubbles.

Next, a relation between the recording head unit 50 and the ink storage/filling portion 52 is described in more detail.

Figure 4:
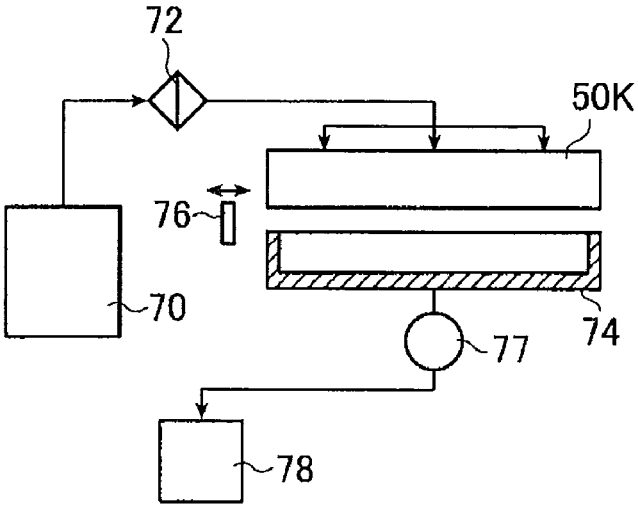
FIG. 4 is a schematic diagram illustrating a configuration of an ink supply system and the surroundings of a head in the image recording apparatus.

FIG. 4 is a schematic diagram illustrating a configuration of the ink supply system and the surroundings of the heads of the image recording apparatus 10. It should be noted that relations between the respective recording heads 50K, 50C, 50M, and 50Y and the ink storage/filling portion 52 are the same except for the type of ink. Hence, only the relation between the recording head 50K and the ink storage/filling portion 52 is described, and description on the relations between the respective recording heads 50C, 50M, and 50Y and the ink storage/filling portion 52 is omitted.

An ink supply tank 70 is a tank for storing ink having a color which corresponds to the recording head 50K, that is, black ink, and is placed inside the ink storage/filling portion 52. Further, the recording head 50K and the ink supply tank 70 are coupled to each other via a supply pipe.

In the middle of the flow path connecting the ink supply tank 70 and the recording head 50K, a filter 72 for removing foreign material and bubbles is provided. It is desirable that the filter mesh size of the filter 72 be equal to or smaller than a nozzle diameter (in general, approximately 20 μm).

It is desirable that a sub-tank be provided in the vicinity of the recording head 50K or be incorporated in the recording head 50K. With the sub-tank being provided, it is possible to obtain a damper effect, which prevents fluctuations in the internal pressure of the head, and hence refilling can be improved.

Further, as illustrated in FIG. 4, the image recording apparatus 10 is provided, as means for preventing the nozzle 62 from drying or preventing the ink viscosity in the vicinity of the nozzle 62 from increasing, with a cap 74, a suction pump 77, and a collection tank 78, and is also provided with a cleaning blade 76 as means for cleaning a nozzle surface of the recording head 50K, that is, a surface at which the nozzle 62 is opened.

A maintenance unit including the cap 74 and the cleaning blade 76 is capable of moving relative to the recording head 50K with the aid of a movement mechanism (not shown), and is moved, as needed, from a given pull-off position to a maintenance position below the recording head 50K.

At the maintenance position, the cap 74 is placed opposite to the recording head 50K, and supported in a vertically-movable manner relative to the recording head unit 50 with the aid of a lifting mechanism (not shown).

The cap 74 is lifted up to a given position by the lifting mechanism (not shown) under conditions of power-off or print standby, and is brought into close contact with the recording head 50K, whereby the nozzle surface of the recording head 50K is covered with the cap 74.

In this manner, by covering the nozzle surface of the recording head 50K with the cap 74 to make a sealed state, it is possible to prevent the ink inside the nozzle from drying and becoming stiff, and prevent the ink viscosity from increasing due to evaporation of ink solvent.

Alternatively, at the time of maintenance or at fixed intervals, the ink may be ejected from the nozzle 62 by driving the actuator 66 after the cap 74 is mounted on the recording head 50K.

If, during the drawing or on standby, a particular nozzle 62 of the recording head 50K is used less frequently, and the situation in which the ink is not ejected is continued for a certain period of time or longer, the ink solvent in the vicinity of that nozzle evaporates, making the ink viscosity higher. Then, in some cases, it becomes impossible to eject the ink from the nozzle 62. However, by preliminarily ejecting the ink to the cap 74 (purging, dummy ejection, or spitting), it is possible to discharge deteriorated ink inside the nozzle 62 (ink in the vicinity of the nozzle, which has an increased viscosity) from the nozzle 62. With this configuration, it becomes possible to prevent the ink from clogging in the nozzle 62, and also, variations in ejection characteristic among the nozzles 62, which result from different ink viscosities, can be prevented. Therefore, ink droplets can be ejected stably.

The suction pump 77 has one end connected to the cap 74 and the other end connected to the collection tank 78. In a state in which the cap 74 is mounted on the recording head 50K in close contact with each other, the suction pump 77 performs suction, whereby the ink inside the nozzle 62 is sucked out. Further, the ink sucked out by the suction pump 77 is delivered to the collection tank 78.

In this manner, by sucking out the ink by the suction pump 77, even if the ink inside the recording head 50K (inside the pressure chamber 63) has bubbles mixed therein and cannot be ejected from the nozzle by operating the actuator 66, for example, the ink inside the pressure chamber 63 (ink with bubbles mixed therein) is sucked out by the suction pump 77, and thereby can be removed by the suction. In other words, it is possible to create a situation in which ink droplets can be ejected.

It should be noted that the suction by the suction pump 77 is desirably also performed when ink is initially loaded into the head, or when the head is used again after suspension over a long period of time, so as to suck out deteriorated ink having an increased viscosity (which has become solidified).

Incidentally, the suction by the suction pump 77 is performed with respect to the entire ink inside the pressure chamber 63, which therefore makes the amount of consumed-ink large. Accordingly, when the degree of increase of the ink viscosity is small, the above-mentioned mode in which ejection of ink droplets to the cap 74 (preliminary ejection) is performed is more desirable.

The cleaning blade 76 is formed with an elastic material such as rubber, and is placed, at the time of maintenance, in contact with the nozzle surface of the recording head 50K. Further, the cleaning blade 76 is connected to a blade-moving mechanism (wiper) (not shown), and is slid on the nozzle surface by the blade-moving mechanism. With the cleaning blade 76 sliding on the nozzle surface, ink droplets and foreign material attached to the nozzle surface are wiped out and removed. In other words, the nozzle surface can be cleaned up.

It should be noted that, when adherents on the ink ejection surface are cleaned up by the blade mechanism, the preliminary ejection is desirably performed so as to prevent foreign material from being intruded into the nozzle 62 by the cleaning blade 76.

Referring back to FIG. 1, the other portions of the image recording apparatus 10 are described.

The heat-pressing portion 18, which includes a post-drying portion 53 and a pressure roller pair 54, heats and presses the recording medium P on which an image has been drawn in the drawing portion 16, whereby the image area is dried and fixed.

The post-drying portion 53 is placed at a position downstream of the recording head unit 50 along the conveying path of the recording medium P and opposed to the belt 38. The post-drying portion 53 is, for example, a heating fan, and blows heated air onto the image surface of the recording medium P to dry the drawn image.

Here, it is desirable that a heating fan be used for the post-drying portion 53 to blow heated air.

With the aid of the heating fan drying the ink of the image area on the recording medium P, it is possible to dry the image area with no contact therewith. With this configuration, it is possible to prevent an image defect or an image smudge from occurring to the image drawn on the recording medium P.

Further, the pressure roller pair 54 is placed downstream of the post-drying portion 53 along the conveying path of the recording medium P. The pressure roller pair 54 conveys in a sandwiching manner the recording medium P, which has been separated from the belt 38 after passing through the post-drying portion 53.

The pressure roller pair 54, which is means for controlling the gloss level of the surface of an image, applies a pressure with its pressure rollers having a given surface asperity to the image surface of the recording medium P conveyed by the attraction belt conveying portion 36 while heating the image surface, thereby transferring the asperity onto the image surface.

Further, in a case where porous paper is printed using dye-based ink or in another case, by closing pores of the paper through pressing, it is possible to prevent contact with a substance which causes dyestuff molecules to be broken, such as ozone. As a result, the weatherability of the image can be enhanced.

Further, the image recording apparatus 10 has a cutter (second cutter) 56 placed downstream of the heat-pressing portion 18 along the conveying path of the recording medium P.

The cutter 56 includes a fixed blade 56A and a round blade 56B, and, in a case where a normal image and an image for detecting displacement are formed on the recording medium P, separates the normal image portion from the image portion for detecting displacement.

The discharging portion 20, which includes a first discharging portion 58A and a second discharging portion 58B, is placed downstream of the cutter 56 in the conveying direction of the recording medium P. The discharging portion 20 discharges the recording medium P on which the image has been fixed by the heat-pressing portion 18.

Here, in this embodiment, in accordance with the image recorded on the recording medium P, selection means (not shown) switches over between the discharging portions for discharging the recording medium P. A recording medium on which a normal image has been drawn is delivered to the first discharging portion 58A, while a recording medium on which an image for detecting displacement has been drawn or an unnecessary recording medium is delivered to the second discharging portion 58B.

Incidentally, it is desirable that the discharging portion 20 be provided with a sorter which collects images on an order basis.

It should be noted that, as in this embodiment, two discharging portions are desirably provided to enable selection between the discharging portions depending on the purpose, but the present invention is not limited thereto. Only one discharging portion may be provided, and discharge all recording media. Alternatively, three or more discharging portions may be provided.

Next, the control portion 22 controls the conveyance, heating, drawing, image unevenness detection, and the like for the recording medium P, which are performed by the feeding portion 12, the conveying portion 14, the drawing portion 16, the heat-pressing portion 18, the discharging portion 20, and the scanner 24. The configuration of the control portion 22 is described below in detail.

The scanner 24 is opposed to the outer surface (outer circumferential surface) of the belt 38, and is placed at a position between the recording head unit 50 and the post-drying portion 53. The scanner 24 includes an image sensor (line sensor or the like) for imaging (i.e., reading) a test pattern formed by the drawing portion 16, and reads an image recorded on a recording medium with the image sensor. It should be noted that the scanner 24 is capable of reading an image with at least two different resolutions, and switches the resolution for reading in accordance with the mode.

The scanner 24 according to this embodiment is configured by a line sensor having a line of light receiving elements, which ranges beyond the width for ink ejection performed by each recording head 50K, 50C, 50M, or 50Y (image recording width). This line sensor is a color separation line CCD sensor having a red (R) sensor line in which photoelectric conversion elements (pixels) provided with red filters are arranged in line, a green (G) sensor line provided with green filters, and a blue (B) sensor line provided with a blue filters. It should be noted that, instead of the line sensor, an area sensor in which light receiving elements are two-dimensionally arranged can be employed.

Figure 5:
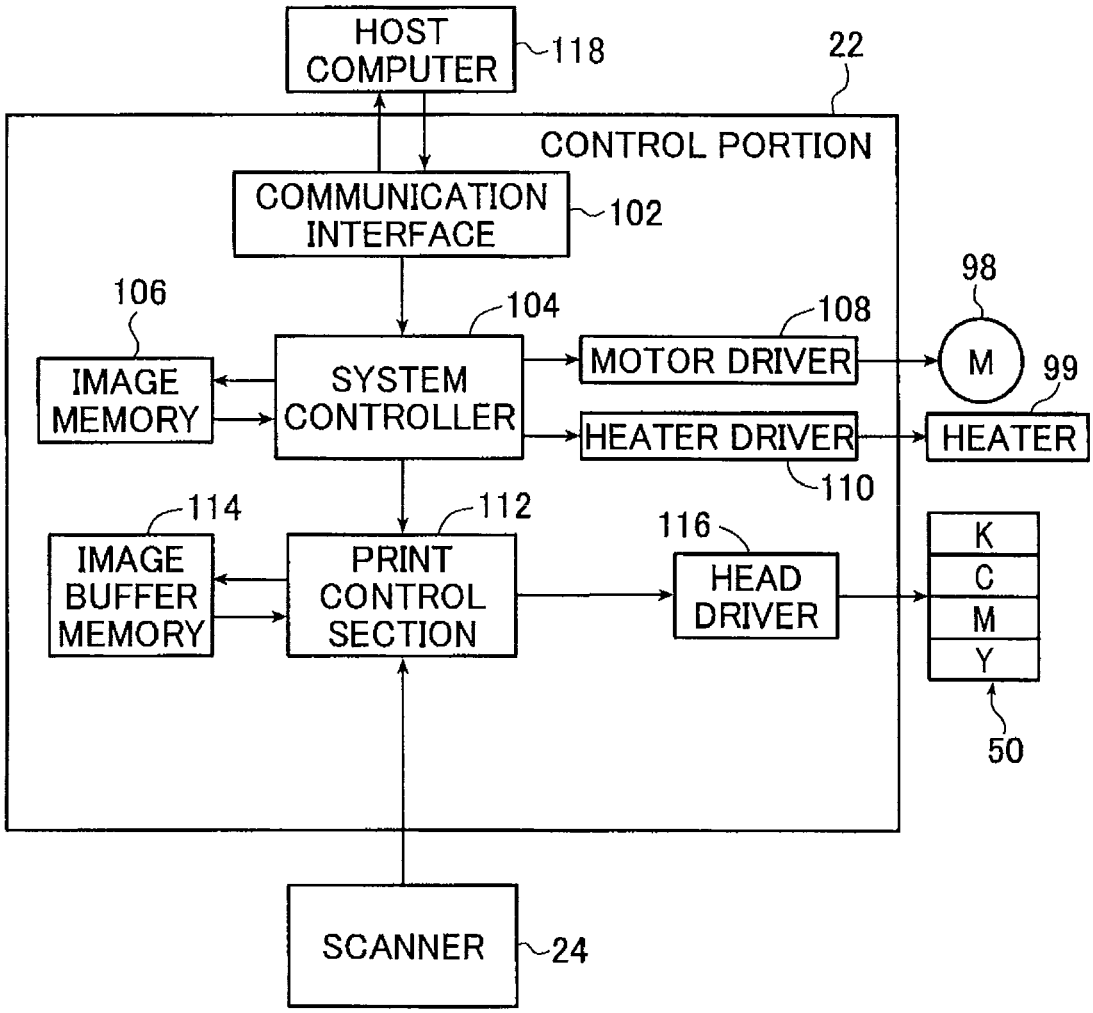
FIG. 5 is a block diagram illustrating a system configuration of a control portion illustrated in FIG. 1.

FIG. 5 is a block diagram illustrating a system configuration of the control portion 22 of the image recording apparatus 10.

The control portion 22 includes a communication interface 102, a system controller 104, an image memory 106, a motor driver 108, a heater driver 110, a print control section 112, an image buffer memory 114, and a head driver 116. As described above, the control portion 22 controls the conveyance, heating, drawing, detection of displacement, and the like for the recording medium P, which are performed by the feeding portion 12, the conveying portion 14, the drawing portion 16, the heat-pressing portion 18, the discharging portion 20, and the scanner 24.

The system controller 104 is a control section for controlling such sections as the communication interface 102, the image memory 106, the motor driver 108, and the heater driver 110. The system controller 104 is configured by a central processing unit (CPU) and peripheral circuits thereof, and controls communication with a host computer 118 and reading from/writing to the image memory 106, as well as generates control signals for controlling a motor 98 for the conveyance system and a heater 99.

The communication interface 102 receives image data transmitted from the host computer 118, and then transmits the image data to the system controller 104. As the communication interface 102, serial interfaces, such as a USB, the IEEE 1394, the Ethernet (registered trademark), and a wireless network, and parallel interfaces such as centronics can be used. Further, a buffer memory may be provided to make a communication speed higher.

The image memory 106 is storage means for temporarily storing an image which has been input via the communication interface 102, and data is read therefrom/written thereto via the system controller 104. The image memory 106 is not limited to a memory comprised of semiconductor devices, and such a magnetic medium as a hard disk may be used.

The image data transmitted from the host computer 118 is loaded into the image recording apparatus 10 via the communication interface 102, and then is stored in the image memory 106 via the system controller 104.

The motor driver 108 is a driver (drive circuit) for driving the motor 98 in accordance with an instruction from the system controller 104.

The heater driver 110 is a driver for driving the heater 99 of the post-drying portion 53 or the like, in accordance with an instruction from the system controller 104.

The print control section 112 is a control section which has a signal processing function, that is to say, performs, under the control of the system controller 104, such processing as various kinds of processes for generating a print control signal from the image data within the image memory 106, and density unevenness correction, and supplies to the head driver 116 the print control signal (print data) generated from the image data.

The print control section 112 carries out required signal processing, and controls, based on the image data, ejection timing of ink droplets of the recording head unit 50 via the head driver 116. In this manner, desired dot placement can be realized.

Figure 6:
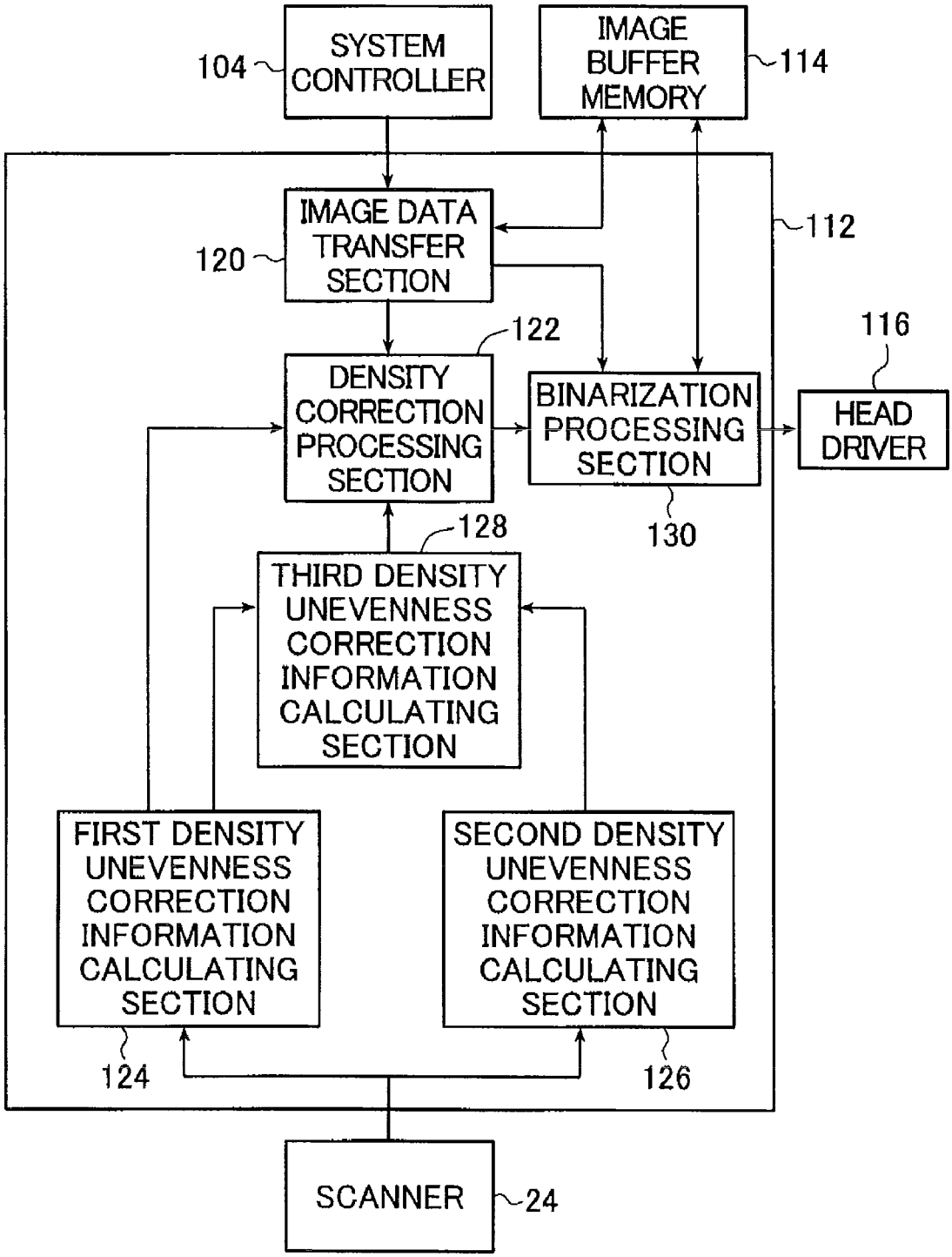
FIG. 6 is a block diagram illustrating a system configuration of a print control section illustrated in FIG. 5.

Here, FIG. 6 is a block diagram illustrating a system configuration of the print control section 112.

As illustrated in FIG. 6, the print control section 112 includes an image data transfer section 120, a density correction processing section 122, a first density unevenness correction information calculating section 124, a second density unevenness correction information calculating section 126, a third density unevenness correction information calculating section 128, and a binarization processing section 130. Further, the print control section 112 is provided with the image buffer memory 114.

The image buffer memory 114 temporarily stores such data as image data and parameters at the time of the image data processing performed by the print control section 112. It should be noted that, in FIGS. 5 and 6, the image buffer memory 114 is illustrated as being attached to the print control section 112, but the image memory 106 can also be used as the image buffer memory 114 at a time. Further, it is also possible to integrate the print control section 112 with the system controller 104 into a system configured by one processor.

The image data transfer section 120 receives image data supplied (input) from the system controller 104, and transmits the image data to the density correction processing section 122 or the binarization processing section 130. In accordance with the type of the supplied image data, the image data transfer section 120 switches over between the density correction processing section 122 and the binarization processing section 130 as to where the image data is to be transmitted.

Here, if necessary, the image data may be temporarily stored in the image buffer memory 114. Then, the image data is retrieved from the image buffer memory 114 and transmitted to the density correction processing section 122 or the binarization processing section 130.

The density correction processing section 122 carries out density unevenness correction processing with respect to the image data which has been transferred from the image data transfer section 120, based on density unevenness correction information (described below) supplied from the second density unevenness correction information calculating section 126 or the third density unevenness correction information calculating section 128, and then transmits unevenness-corrected image data to the binarization processing section 130.

Based on a first test pattern which is read by the scanner 24, the first density unevenness correction information calculating section 124 calculates, as first density unevenness correction information, high-frequency density unevenness caused by a landing position error of the ejection portions. Further, the first density unevenness correction information calculating section 124 transmits the calculated first density unevenness correction information to the third density unevenness correction information calculating section 128. In addition, if necessary, the first density unevenness correction information calculating section 124 transmits the first density unevenness correction information to the density correction processing section 122.

Based on a second test pattern which is read by the scanner 24, the second density unevenness correction information calculating section 126 calculates, as second density unevenness correction information, low-frequency density unevenness caused by a fluctuation of the diameters of droplets (or landing diameters of droplets) ejected from the ejection portions. The second density unevenness correction information calculating section 126 transmits the calculated second density unevenness correction information to the third density unevenness correction information calculating section 128.

The third density unevenness correction information calculating section 128 calculates third density unevenness correction information based on the first density unevenness correction information transmitted from the first density unevenness correction information calculating section 124 and the second density unevenness correction information transmitted from the second density unevenness correction information calculating section 126. The third density unevenness correction information calculating section 128 transmits the calculated third density unevenness correction information to the density correction processing section 122.

Here, calculation methods for the first density unevenness correction information, the second density unevenness correction information, and the third density unevenness correction information are described below in detail.

Next, the binarization processing section 130 carries out binarization processing with respect to the image data which is directly transmitted from the image data transfer section 120 or the unevenness-corrected image data which is transmitted from the density correction processing section 122, and then generates a print control signal. Specifically, in order to record the supplied image data on a recording medium, based on the image data, the binarization processing section 130 determines ON/OF timing of ejection (in other words, ejection pattern) for each ejection portion of the recording head unit 50, and generates that timing as a print control signal. The binarization processing section 130 transmits the generated print control signal to the head driver 116.

It should be noted that various kinds of processing methods may be used for the binarization processing section 130 to generate an ejection control signal from the image data. For example, a dithering method or an error diffusion method may be used.

Next, based on the ejection control signal (print data) provided from the print control section 112, the head driver 116 drives the actuator of each ejection portion of the recording heads 50K, 50C, 50M, and 50Y of different colors. The head driver 116 may include a feedback control system for keeping a head driving condition constant.

The image recording apparatus 10 is basically configured in the above-mentioned manner.

Next, a method of creating the third density unevenness correction information, which is used by the image recording apparatus 10, is described. Here, the method of creating the third density unevenness correction information is performed in the same manner for any one of the recording heads 50K, 50C, 50M, and 50Y, and hence, the following description is made concerning the recording head 50K as an example.

Figure 7A:
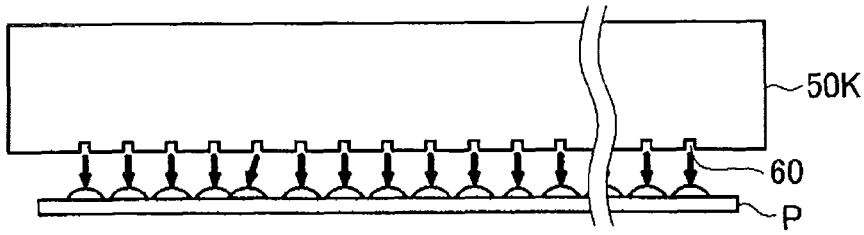
FIG. 7A is a side view illustrating a relation between each ejection portion of a recording head and a landing position of an ink droplet.
Figure 7B:
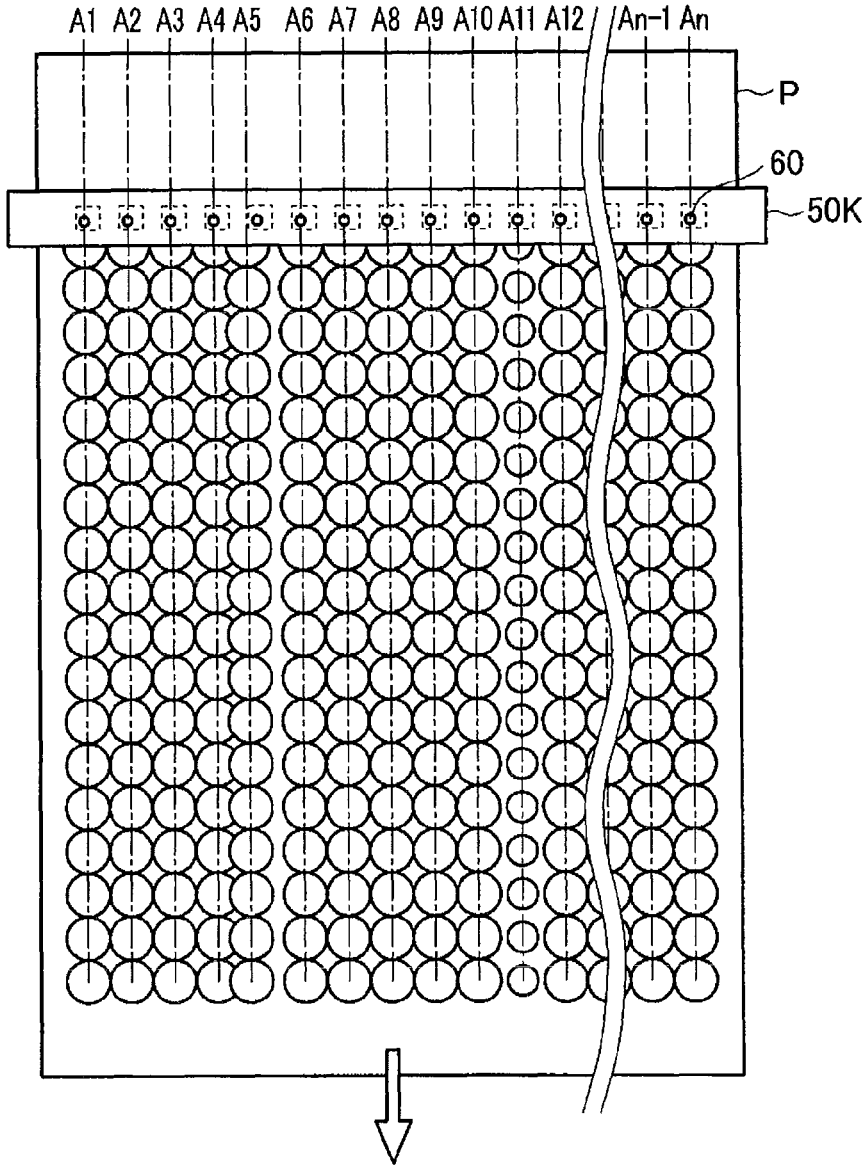
FIG. 7B is a top view associated with the side view of FIG. 7A.

FIG. 7A is a side view illustrating a relation between each ejection portion of the recording head and the landing position of an ink droplet, and FIG. 7B is a top view associated with the side view of FIG. 7A. It should be noted that, in FIGS. 7A and 7B as well as in this embodiment as described hereinbelow, a plurality of ejection portions arranged in line are defined as A1, A2, A3, . . . , and An in the arranged order from one end to the other end.

As illustrated in FIG. 7A and FIG. 7B, when an ink droplet ejected from one ejection portion (in FIGS. 7A and 7B, ejection portion 60 numbered A5) is ejected in a different direction from ink droplets ejected from other ejection portions, the position of impact point of that ink droplet is displaced, that is, the landing position of the ink droplet is displaced. As a result, density unevenness occurs to the formed image.

Further, as illustrated in FIG. 7A and FIG. 7B, when the ink amount of an ink droplet ejected from one ejection portion (in FIGS. 7A and 7B, ejection portion 60 numbered A11) is smaller than a desired amount, an impact point formed by the ink droplet ejected from that ejection portion 60 becomes smaller in size than the impact points of ink droplets ejected from other ejection portions. Also when the size of the impact point is different from the desired size, density unevenness occurs to the formed image.

The above-mentioned third density unevenness correction information is correction information for correcting the ejection characteristics of an ink droplet ejected from an ejection portion, such as the landing position and the ink amount, which cause the above-mentioned density unevenness.

By correcting the image data based on the third density unevenness correction information, even when an image is recorded using the recording head unit involving density unevenness, it is possible to create an image which seems to have no density unevenness on a recording medium.

Figure 8:
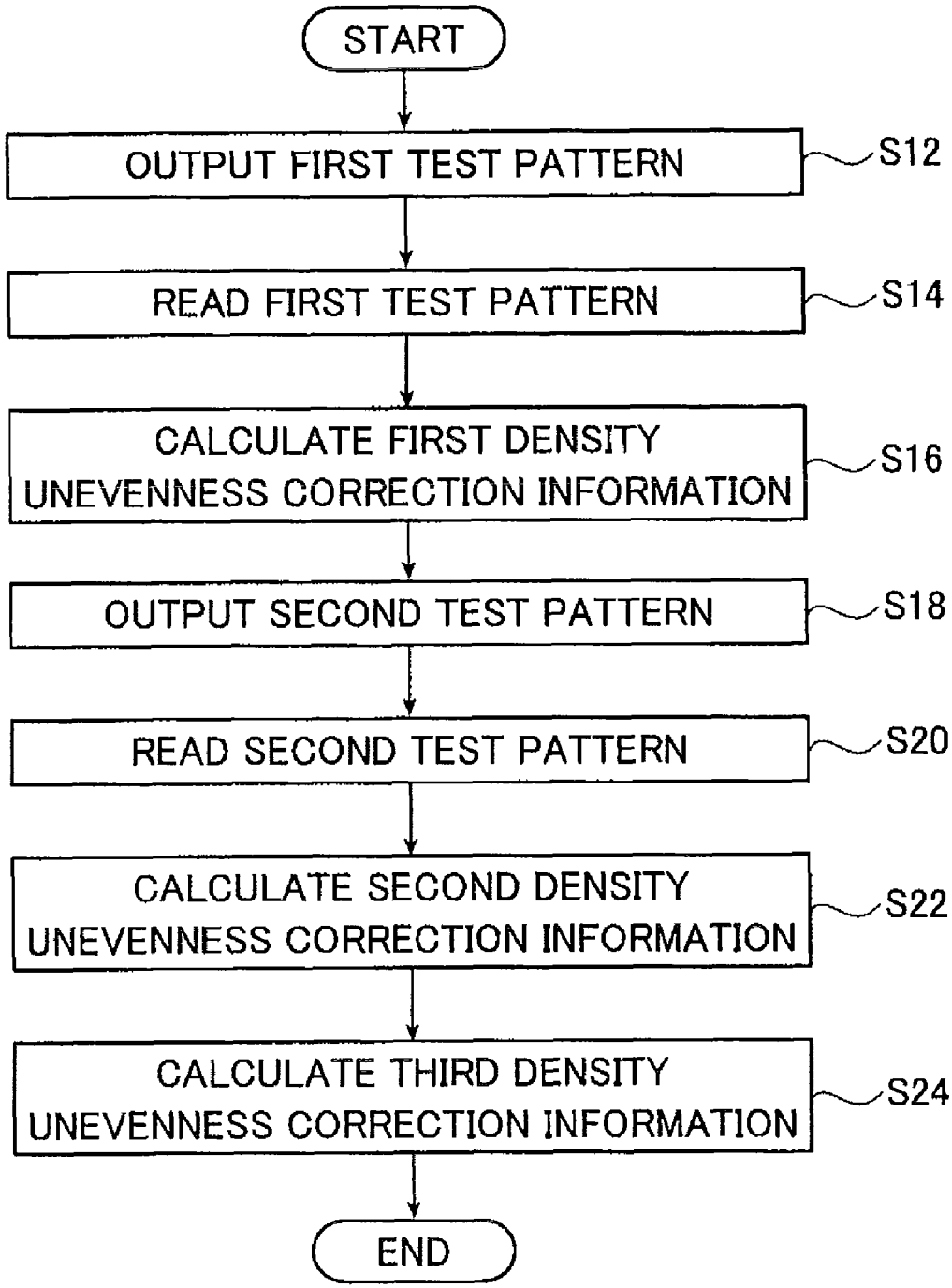
FIG. 8 is a flow chart illustrating steps of a process for creating third density unevenness correction information.
Figure 9A:
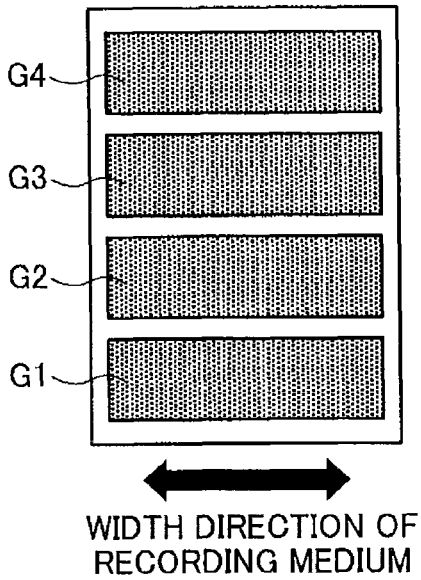
FIG. 9A is a schematic diagram illustrating an example of a first test pattern.
Figure 9B:
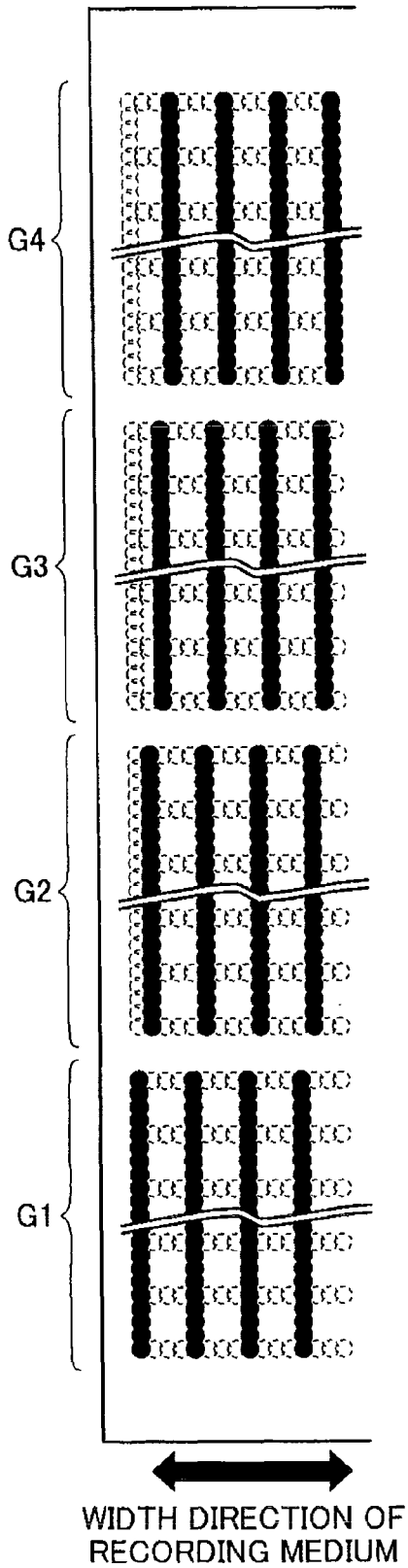
FIG. 9B is a partially enlarged view of FIG. 9A.
Figure 10:
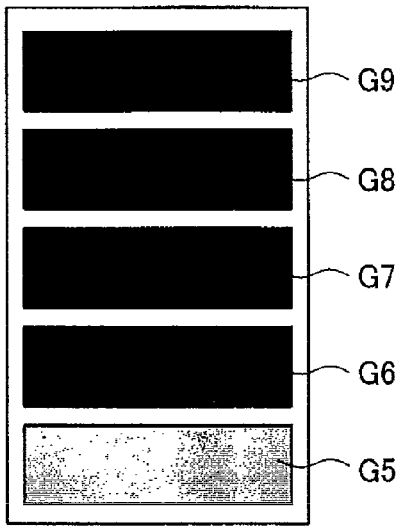
FIG. 10 is a schematic diagram illustrating an example of a second test pattern.
Figure 11A:
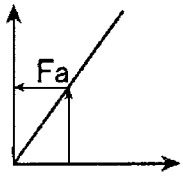
FIG. 11A is a graph illustrating an example of first density unevenness correction information for one recording element.
Figure 11B:
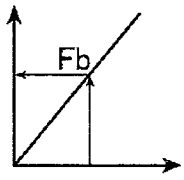
FIG. 11B is a graph illustrating an example of second density unevenness correction information for one recording element.
Figure 11C:
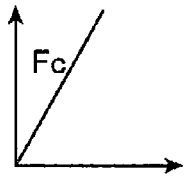
FIG. 11C is a graph illustrating an example of the third density unevenness correction information for one recording element.

FIG. 8 is a flow chart illustrating the steps of a process for creating the third density unevenness correction information. FIG. 9A is a schematic diagram illustrating an example of the first test pattern, and FIG. 9B is a partially enlarged view of FIG. 9A. Further, FIG. 10 is a schematic diagram illustrating an example of the second test pattern. Further, FIG. 11A is a graph illustrating an example of the first density unevenness correction information for one recording element, FIG. 11B is a graph illustrating an example of the second density unevenness correction information for one recording element, and FIG. 11C is a graph illustrating an example of the third density unevenness correction information for one recording element. Each recording element has such density unevenness correction information as described above.

First, the recording head 50K draws the first test pattern on the recording medium P (Step S12).

Specifically, when a plurality of ejection portions arranged in line are, as described above, defined as A1, A2, A3, . . . , and An in the arranged order from one end to the other end (see FIGS. 7A and 7B), the ejection portions are divided into four groups of 4k-3, 4k-2, 4k-1, and 4k (k=1, 2, 3, . . . ) based on the number of an ejection portion. Ink droplets are ejected continuously from ejection portions having the numbers expressed by 4k-3, and the lines are formed on the recording medium P by the respective ejection portions. Then, ink droplets are ejected continuously from ejection portions having the numbers expressed by 4k-2, and the lines are formed on the recording medium P by the respective ejection portions. Then, similarly, with regard to ejection portions having the numbers expressed by 4k-1, and ejection portions having the numbers expressed by 4k, the lines are formed on the recording medium P by the respective ejection portions.

By making a group with ejection portions spaced apart from each other at fixed intervals, it is possible to form lines without ejecting ink from adjacent ejection portions. With this method, overlapping of lines can be prevented.

Incidentally, in this embodiment, while the recording medium P is conveyed by the conveying portion 14 in the conveying direction, that is, a direction perpendicular to the recording head 50K, ink droplets are ejected from each ejection portion of the recording head 50K to form impact points on the recording medium P.

In this manner, as illustrated in FIG. 9A and FIG. 9B, the first test pattern is formed on the recording medium P that consists of the lines formed by the respective ejection portions and grouped into four (G1, G2, G3, and G4) corresponding to the four groups of ejection portions.

Next, the first test pattern formed on the recording medium P is read by the scanner 24 (Step S14).

Specifically, after the formation of the first test pattern, the recording medium P is further conveyed by the conveying portion 14, and passes a position opposed to the scanner 24.

The scanner 24 reads the image formed on the recording medium P passing through the position opposed thereto, thereby reading the first test pattern. It should be noted that, at this time, the scanner 24 reads the first test pattern in a high resolution.

Further, the scanner 24 transmits the read image data to the first density unevenness correction information calculating section 124 of the control portion 22.

Next, the first density unevenness correction information calculating section 124 calculates the first density unevenness correction information based on the first test pattern (Step S16).

First, based on image data obtained by reading the first test pattern in which the lines are formed by the respective ejection portions, the first density unevenness correction information calculating section 124 calculates the landing position (ejection characteristic) of ink droplets from each ejection portion.

Here, with regard to the landing position, as disclosed in JP 2006-264069 A, for example, by detecting a density profile of each line and calculating the center of each line based on the detection result, it is possible to calculate the landing position of ink droplets ejected from each ejection portion.

Further, a method of calculating the center position is not limited in particular. By detecting both edges of an ink droplet, the middle point thereof may be set as the center, or a position having the highest density may be set as the center.

Further, with regard to the landing position, it is desirable that the centers be calculated at a plurality of points in each line, and that an approximate line be calculated by connecting the centers. The calculation of the approximate line by connecting a plurality of centers enables more accurate detection of the landing position of ink droplets.

Further, by extending the approximate line, it is possible to detect accurately a relative positional relation among the groups. It should be noted that the relative positional relation can be obtained as follows. A reference ejection portion is set at the time of creating the first test pattern, and a line formed by the reference ejection portion is allowed to be formed in all of the four groups.

The first density unevenness correction information calculating section 124 calculates the first density unevenness correction information based on the calculated landing position information of each ejection portion. Here, the first density unevenness correction information is information (parameter or correction coefficient for each ejection portion) for correcting density unevenness based on the landing position information of each ejection portion.

Here, a method of calculating the first density unevenness correction information based on the calculated landing position information of each ejection portion is not limited in particular. The first density unevenness correction information may be calculated based on the landing position information by performing averaging processing so that the density of an area corresponding to an ejection portion comes close to a reference density, as disclosed in JP 2006-264069 A. Alternatively, as disclosed in JP 2006-347164 A, the first density unevenness correction information may be calculated based on the landing position information by performing numerical calculation processing among the ejection portion in question and a plurality of ejection portions adjacent thereto.

Next, the recording head 50K draws the second test pattern on the recording medium P (Step S18).

Specifically, the recording head 50K ejects ink droplets from all the ejection portions thereof to thereby record solid images (images having a fixed density within a fixed area) having different densities. In this embodiment, as illustrated in FIG. 10, solid images having densities of 20%, 40%, 60%, 80%, and 100% are formed in image areas G5, G6, G7, G8, and G9, respectively.

Here, the print control section 112 corrects the second test pattern using the first density unevenness correction information calculated by the first density unevenness correction information calculating section 124, and converts the density-corrected second test pattern into ejection control signals. Then, based on the ejection control signals, the print control section 112 allows the drawing of the second test pattern on the recording medium P.

Specifically, the image data transfer section 120 transmits, to the density correction processing section 122, image data of the second test pattern (five solid images having different densities) transmitted from the system controller 104. The density correction processing section 122 carries out the density unevenness correction processing with respect to the second test pattern based on the first density unevenness correction information. In other words, in order that density unevenness caused by a landing position error does not occur to the second test pattern to be recorded on the recording medium P, the density correction processing section 122 carries out, with respect to the image data of the second test pattern, such density unevenness correction processing that takes into account the landing position error of an ejection portion.

The density correction processing section 122 transmits the image data of the density-corrected second test pattern to the binarization processing section 130.

The binarization processing section 130 performs the binarization processing with respect to the image data of the density-corrected second test pattern, and then generates an ejection control signal. Further, the generated ejection control signal is transmitted to the head driver 116, and then, the recording head 50K records the image on the recording medium P based on the ejection control signal, whereby the second test pattern is drawn.

Next, the scanner 24 reads the second test pattern formed on the recording medium P (Step S20).

Specifically, after the formation of the second test pattern, the recording medium P is further conveyed by the conveying portion 14, and passes a position opposed to the scanner 24.

The scanner 24 reads the image formed on the recording medium P passing through the position opposed thereto, thereby reading the second test pattern. It should be noted that, at this time, the scanner 24 reads the second test pattern in a lower resolution than that in which the first test pattern is read.

Further, the scanner 24 transmits the read image data to the second density unevenness correction information calculating section 126 of the control portion 22.

Next, the second density unevenness correction information calculating section 126 calculates the second density unevenness correction information based on the second test pattern (Step S22).

The second density unevenness correction information calculating section 126 calculates density variation based on the image data obtained by reading the second test pattern in which a plurality of solid images having different densities are formed.

Next, based on the calculated density variation, the ejected droplet amount (ejection characteristic) of each ejection portion is calculated.

Here, as described above, the second test pattern has been subjected to the density unevenness correction based on the first density unevenness correction information, and hence, in a case where ink droplets having a uniform droplet amount are ejected from the respective ejection portions, an image with a fixed density, which has no density variation, is formed. Accordingly, density variation of a solid image can be detected as fluctuation in the amount of droplets ejected from the respective ejection portions, and hence, based on the density variation and the landing position information calculated using the first test pattern, the amount of an ink droplet ejected from each ejection portion can be calculated. Further, from the results of the above-mentioned calculation, density unevenness caused by the fluctuation in amount (variation amount) of ink droplets ejected from the respective ejection portions can be calculated.

Further, solid images having different image densities are created, and, based on a plurality of calculated values, the amount of an ink droplet ejected from each ejection portion is calculated, and hence it is possible to more accurately calculate the density unevenness caused by the fluctuation in the amount of ink droplets. Further, it is also possible to calculate density unevenness caused by the fluctuation in the amount of ink droplets for each density.

Next, the second density unevenness correction information calculating section 126 calculates the second density unevenness correction information based on the calculated density variation caused by the fluctuation in the amount of ink droplets ejected from the respective ejection portions. Here, the second density unevenness correction information is information (parameter or correction coefficient for each ejection portion) for correcting the density unevenness caused by the fluctuation in the liquid amount of ink droplets ejected from the respective ejection portions.

For example, in a case where the amount of droplets ejected from an ejection portion is smaller than the average, correction information for making the setting so that ink droplets are ejected, with respect to a particular image density, more frequently than those from the other ejection portions is calculated. In a case where the amount of droplets ejected from an ejection portion is larger than the average, correction information for making the setting so that ink droplets are ejected, with respect to a particular image density, less frequently than those from the other ejection portions is calculated. Further, such a correction coefficient is calculated as below. In a case where the density of a particular area is low, the correction coefficient sets higher the ink ejection frequency of ejection portions corresponding to the area, while in a case where the density of a particular area is high, the correction coefficient sets lower the ink ejection frequency of ejection portions corresponding to the area.

Further, the present invention is not limited to correction which is performed using the ejection frequency of one ejection portion. By using adjacent ejection portions or the like, the correction coefficient may be calculated so that an image which can be recognized, by the naked eye, to have a desired density is formed or so that such a variation amount that cannot be recognized as unevenness by the naked eye can be attained.

Next, the third density unevenness correction information calculating section 128 calculates the third density unevenness correction information (Step S24).

The third density unevenness correction information calculating section 128 calculates the third density unevenness correction information based on the first density unevenness correction information calculated by the first density unevenness correction information calculating section 124 and the second density unevenness correction information calculated by the second density unevenness correction information calculating section 126. By calculating the third density unevenness correction information based on the first density unevenness correction information and the second density unevenness correction information, the third density unevenness correction information serves as correction information enabling to correct density unevenness caused by both the landing position of an ink droplet ejected from an ejection portion and the amount of an ink droplet ejected from an ejection portion.

Specifically, using both a relation between input tone value on the abscissa and correction tone value on the ordinate, which is calculated as the first density unevenness correction information with respect to a recording element and illustrated in FIG. 11A, and a relation between input tone value on the abscissa and correction tone value on the ordinate, which is calculated as the second density unevenness correction information with respect to a recording element and illustrated in FIG. 11B, such a relation between input tone value on the abscissa and correction tone value on the ordinate that is illustrated in FIG. 11C is calculated as the third density unevenness correction information. The above-mentioned calculation is performed for every recording element, whereby correction information for all the recording elements is calculated.

It should be noted that the calculation (composition) of third density unevenness correction information Fc may be performed by combining first density unevenness correction information Fa and second density unevenness correction information Fb with the first density unevenness correction information Fa being a variable (that is, Fc=Fb(Fa)), or with the second density unevenness correction information Fb being a variable (that is, Fc=Fa(Fb)).

In this manner, the image recording apparatus 10 calculates the third density unevenness correction information.

Next, through description of a method of creating a print or a printed material, which employs the image recording apparatus 10, the image recording method and the image recording apparatus according to the present invention are described in more detail.

Figure 12:
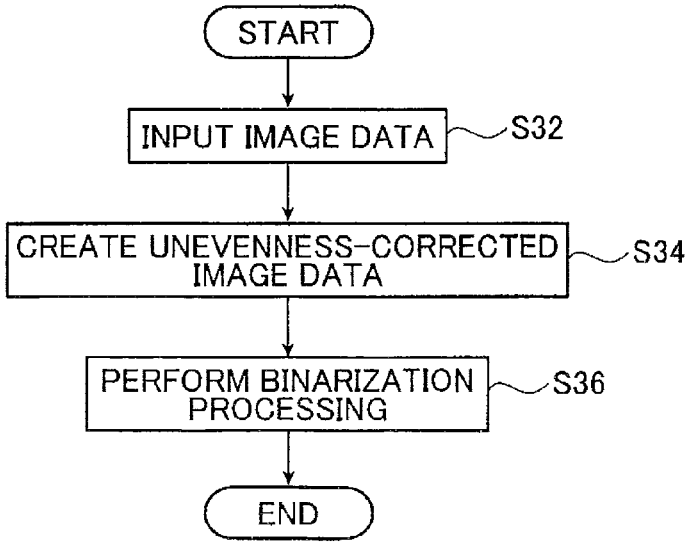
FIG. 12 is a flow chart illustrating a process for processing image data used for printing.

FIG. 12 is a flow chart illustrating a process for processing image data used for printing.

First, image data is input from the host computer 118 to the system controller 104 via the communication interface 102.

After that, the image data is input from the system controller 104 to the image data transfer section 120 of the print control section 112 (Step S32).

The image data transfer section 120 transmits the input image data to the density correction processing section 122.

The density correction processing section 122 uses the third density unevenness correction information to carry out the density unevenness correction on the transmitted image data, and then creates density-corrected image data (Step S34).

The density correction processing section 122 transmits the created density-corrected image data to the binarization processing section 130.

The binarization processing section 130 carries out binarization processing on the density-corrected image data, and then generates an ejection control signal (Step S36).

After that, the binarization processing section 130 transmits the ejection control signal to the head driver 116.

In this manner, the image data is processed, and transmitted to the head driver 116.

Next, a recording operation performed by the image recording apparatus 10 is described.

First, the recording medium P fed from the magazine 30 of the feeding portion 12 is subjected to the decurling processing by the heating drum 32, and made flat. After that, the recording medium P is cut into a predetermined length by the cutter 34, and is fed to the conveying portion 14.

The recording medium P fed to the conveying portion 14 is placed on the belt 38 of the attraction belt conveying portion 36, and is conveyed by the circulating belt 38.

The recording medium P conveyed by the attraction belt conveying portion 36 passes through the position opposed to the heating fan 44 and is heated to a predetermined temperature, then passes through the position opposed to the recording head unit 50. When the recording medium P passes through the position opposed to the recording head unit 50, ink droplets are ejected from the respective recording heads in response to the above-mentioned ejection control signals. Ink droplets ejected in order of K, C, M, and Y land on the recording medium P, and an image is formed on the recording medium P.

It should be noted that, when the recording medium P passes through the position opposed to the recording head unit 50, the recording medium P is under suction by the attraction chamber 39, and hence a distance between the recording medium P and the recording head unit 50 is made constant. Further, while the recording medium P is conveyed, color inks are ejected from the respective recording heads 50K, 50C, 50M, and 50Y, whereby a colored image is formed on the recording medium P.

The recording medium P on which the image is formed by the recording head unit 50 is further conveyed by the belt 38, and passes through the position opposed to the post-drying portion 53, at which position the image area formed with ink is dried. The image is fixed by the pressure roller pair 54, and then, the recording medium P is discharged from the first discharging portion 58A.

In this manner, the image recording apparatus 10 draws (records) an image on the recording medium P, thereby creating a print or a printed material.

As described above, according to the present invention, the first density unevenness correction information for correcting density unevenness caused by a landing position error and the second density unevenness correction information for correcting density unevenness caused by an ink droplet amount are calculated separately, and, based on those two pieces of correction information, the third density unevenness correction information is calculated. Accordingly, it is possible to suitably correct errors caused by both the landing position error and the ink droplet amount, and an image having little or no density unevenness can be recorded.

It should be noted that, in the description above, density unevenness to be corrected by the first density unevenness correction information is assumed to be such density unevenness that is caused by a landing position error, but the present invention is not limited thereto. The first density unevenness includes high-frequency unevenness (density unevenness having extreme variation) caused by various kinds of reasons (for example, ejection amount fluctuation). Further, density unevenness to be corrected by the second density unevenness correction information is assumed to be such density unevenness that is caused by fluctuation in ink droplet amount, but the present invention is not limited thereto. The second density unevenness includes various kinds of low-frequency density unevenness (density unevenness having moderate variation), such as concentration unevenness of ink ejected from each ejection portion.

Further, by calculating high-frequency density unevenness and low-frequency density unevenness separately, the amount of image reading and the amount of image processing can be reduced, and also, density unevenness can be suitably corrected.

Specifically, a landing position error needs to be calculated from the image data acquired in a resolution exceeding the pixel recording density, that is, the output resolution of the image recording apparatus, at the time of outputting the first test pattern. For example, when the output resolution is 1,200 dpi, the resolution for image data acquirement may be set to 1,200 dpi or more, for example, to 2,400 dpi. With regard to the low-frequency density unevenness, any resolution is applicable as long as unevenness visibly recognizable by a human can be read. Accordingly, in the case where low-frequency density unevenness is detected from a solid image, the calculation is made based on image data acquired by reading in a low resolution (for example, 100 to 600 dpi), whereby the low-frequency density unevenness can be corrected. In consideration of the visual characteristics of a human, it is most desirable that the resolution at this time be set around 200 to 300 dpi, which is a resolution high enough to equalize imperceptible high-frequency unevenness.

In this manner, by also changing the resolution for reading an image in accordance with each characteristic, it is possible to reduce the amount of image reading and the amount of image processing.

Here, as described above, it is desirable that the resolution for reading the first test pattern be set higher than the resolution of an image to be recorded by the recording heads. Specifically, in consideration of the sampling definition, in order to obtain a resolution twice or more as high as the resolution of the recorded object to be measured, it is desirable to set the reading resolution twice or more as high as the resolution (in this embodiment, for example, 1,200 dpi) of an image recorded by the recording head unit (for example, set to 2,400 dpi or more).

By reading in a resolution twice or more as high as the resolution of the recorded image, it is possible to calculate a landing position error accurately.

Further, the reading resolution required at this time may be set uniformly in the following manner only the resolution in a direction of line of recording elements is set to be a high resolution (for example, 2,400 dpi), and the resolution in a direction perpendicular to the line of recording elements is set to be a low resolution (300 dpi). As a result, the reading speed can be increased and the amount of data can be reduced.

Further, the first density unevenness correction information and the second density unevenness correction information do not have to be calculated at one time, but may be detected at separate timings. For example, only the second density unevenness correction information is updated, and, with regarded to the first density unevenness correction information, previous density unevenness correction information (already calculated at the time of update) may be used.

Desirably, the first density unevenness correction information is updated less frequently than the second density unevenness correction information. As described above, with regard to the first density unevenness correction information, an image needs to be read in a high resolution, and hence the amount of image reading and the amount of image processing are increased. However, a cause for high-frequency density unevenness to be corrected by the first density unevenness correction information, such as a landing position error, changes over time by the influence of, for instance, time-dependent degradation of the surface of a recording head on which the openings of nozzles are located, and the change thereof is relatively moderate. Accordingly, the first density unevenness correction information does not change frequently. On the other hand, a cause for low-frequency density unevenness to be corrected by the second density unevenness correction information, such as a drop amount of an ink droplet, depends on temperature change as well, and hence it is necessary that the second density unevenness correction information be updated at shorter intervals.

Accordingly, by updating only the second density unevenness correction information, the amount of image processing can be reduced, and hence the third density unevenness correction information can be calculated in a short period of time. Further, even if only the second density unevenness correction information is updated without updating the first density unevenness correction information, it is possible to correct density unevenness appropriately.

In this manner, by calculating the first density unevenness correction information and the second density unevenness correction information separately, only necessary information can be updated, and hence it becomes possible to calculate appropriate correction information with a less amount of processing.

Further, in the image recording apparatus 10, because a test pattern can be created in a state in which high-frequency density unevenness has been corrected, the image data of the second test pattern is corrected by the first density unevenness correction information, and, with the use of the corrected image data of the second test pattern, the second test pattern is created. However, the present invention is not limited thereto, and the second test pattern may be created without making correction by the first density unevenness correction information.

When the second test pattern is created without making correction by the first density unevenness correction information, the amount of data processing can be reduced at the time of creation of the second test pattern. It should be noted that, in this case, there may occur a case in which the amount of data processing increases when the third density unevenness correction information is calculated.

Further, in the image recording apparatus 10, one scanner reads the first test pattern and the second test pattern recorded on a recording medium, but the present invention is not limited thereto. A scanner for reading the first test pattern and a scanner for reading the second test pattern may be provided separately.

As described above, by providing scanners separately, it is possible to provide scanners dedicated to particular purposes. Specifically, as a scanner for reading the first test pattern, a scanner which reads an image in such a manner as to suitably calculate the position of an impact point (for example, scanner which is low in density gradation, but reads image in high resolution) can be used, while, as a scanner for reading the second test pattern, a scanner which reads an image in such a manner as to suitably calculate the density variation (for example, scanner which is not high in resolution, but reads image with high density gradation) can be used.

With this configuration, density unevenness can be detected more accurately. In addition, switchover between the modes of the scanner becomes unnecessary, and hence the operation becomes easier.

Here, in the case of providing separate scanners, it is desirable that, as the scanner for reading the first test pattern, a scanner capable of reading an image in a higher resolution than the resolution of the scanner for reading the second test pattern be used.

Further, in the above-mentioned image recording apparatus 10, the scanner is provided inside the apparatus on the conveying path of the recording medium (that is, an in-line scanner is used), but the present invention is not limited thereto. The scanner may be provided at a position apart from the conveying path of the recording medium, for example, outside the enclosure of the image recording apparatus (that is, an off-line scanner may be used). A recording medium on which an image is drawn in the image recording apparatus may be read by the scanner provided outside the enclosure of the image recording apparatus, and density unevenness may be detected with the same method as described above.

Further, in the above-mentioned image recording apparatus 10, a method of directly reading a test pattern created by ejecting ink droplets toward a recording medium inside the image recording apparatus is employed, but the present invention is not limited thereto. The present invention is also applicable to a method of indirectly reading a test pattern.

Here, the indirect reading means that a test pattern created on a recording medium is temporarily transferred onto another recording medium for reading. In other words, the recording medium may also be an intermediate transfer member, and the present invention is applicable to a printer using a transfer method in which, after an image is temporarily drawn onto an intermediate transfer member, the image is transferred onto a final recording medium for obtaining an image. Further, in a case of directly reading a test pattern in a printer using the transfer method, an image on the intermediate transfer member is to be read.

For example, the scanner for reading the first test pattern is configured by an off-line scanner, the scanner for reading the second test pattern is configured by an in-line scanner, and, as the scanner for reading the first test pattern, one scanner that is common to a plurality of image recording apparatuses is provided. By doing so, the number of scanners which read an image in a high resolution can be reduced, which enables decreasing the cost on apparatus.

Incidentally, as described above, the first density unevenness correction information does not change abruptly, and hence may be calculated less frequently than the second density unevenness correction information. Accordingly, even if it takes a long period of time for the calculation due to a scanner provided as a separate member, there arises almost no problem in terms of driving apparatus.

Here, in this embodiment, as the first test pattern, the lines are formed in four groups, but the present invention is not limited thereto. The lines may be formed in two groups, in three groups, or in five or more groups.

It should be noted that a landing position may be detected based on one impact point instead of forming lines as in the above-mentioned embodiment.

Further, as long as a state is such that adjacent impact points are not in contact with each other on a recording medium, that is, an impact point and its adjacent impact points are out of contact, impact points to be formed by all the ejection portions may be formed on one and the same line in a direction perpendicular to the conveying direction of the recording medium.

For example, in a case where the size of an ink droplet to be ejected can be adjusted, that is, if the size of an impact point can be adjusted, an impact point may be made smaller by reducing an ink droplet to be ejected, whereby an impact point and its adjacent impact points are made out of contact.

In this manner, by preventing an impact point and its adjacent impact point from being brought into contact with each other, it is possible to calculate both edges of each impact point in a reference direction accurately.

Further, in this embodiment, image data is binarized by the binarization processing section to generate an ejection control signal, but the present invention is not limited thereto. The image data may be digitalized into N discrete values ($N \geqq 2$) in accordance with the ejection capability of the recording heads. For example, in a case where the recording heads are capable of ejecting a large dot and a small dot, the image data may be subjected to ternarization processing so as to generate an ejection control signal having any one of three values indicating "large dot", "small dot", and "no ejection".

Figure 13:
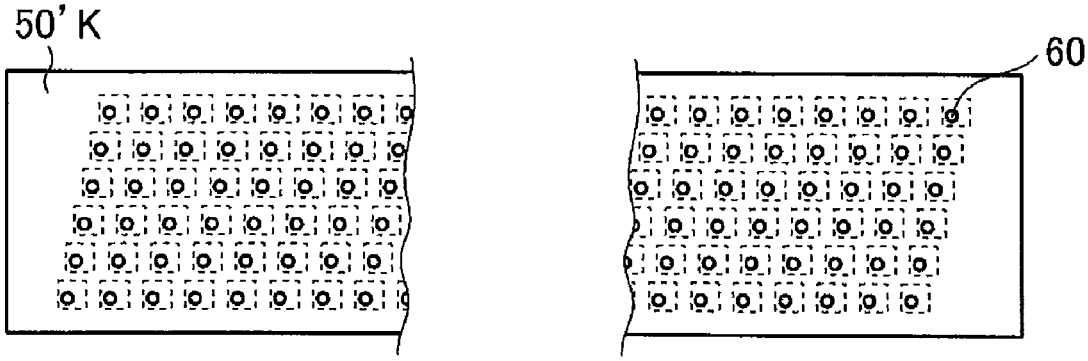
FIG. 13 is a front view illustrating another example of the arrangement pattern of the ejection portions of a recording head.

Further, in this embodiment, the recording heads of the drawing portion are of a full-line head type, with their ejection portions being arranged in one line, but the present invention is not limited to such a configuration comprising a single-line arrangement of ejection portions. As illustrated in FIG. 13, a recording head 50'K may be configured such that a plurality of lines of ejection portions are arranged in a zigzag by shifting the lines with a fixed pitch. In this manner, the ejection portions 60 are arranged in a zigzag, and a line of impact points are formed by a plurality of lines of ejection portions, thereby enabling the formation of an image having a higher resolution.

Further, in this embodiment, the recording head unit is configured in accordance with the standard colors Y, M, C, and K (four colors), but the color of ink, the number of colors, and combination thereof are not limited to this embodiment. For example, light-colored ink or dark-colored ink may be added. More specifically, a configuration in which a recording head for ejecting light-colored ink, such as light cyan or light magenta ink, is added is also applicable, and a configuration of a seven-color ink system in which inks of red (R), green (G), and blue (B) are added, for example, is also applicable.

Further, the recording head unit may be configured as a recording head for ejecting only K-color (black) ink, that is, a single-color recording head unit, and the image drawing apparatus may be used for drawing a single-colored image.

Hereinbefore, the image recording method and the image recording apparatus according to the present invention have been described in detail, but the present invention is not limited to the above-mentioned embodiment, and various modifications and changes may be made without departing from the spirit and scope of the present invention.

For example, in the above-mentioned image recording apparatus, heat-curable ink is used, and the ink which has landed on a recording medium is fixed on the recording medium by the heat-pressing portion. However, the present invention is not limited thereto, and various types of ink may be used. For example, in a case of using photo-curable ink, a light irradiation mechanism may be provided as a fixing portion. Activation energy-curable ink is ejected from a recording head, and an image is formed on the recording medium P with the photo-curable ink. After that, an activation light beam is irradiated to cure the image, whereby the image is fixed on the recording medium. Here, in a case of using UV curable ink as the photo-curable ink, various kinds of ultraviolet light sources, such as a metal halide lamp, a high-pressure mercury-vapor lamp, and a UVLED, may be used as the fixing portion.

Further, in this embodiment, the image recording apparatus is taken as an example, but the present invention is not limited thereto. Detailed description is given below with a specific example, but, to give one example, an image recording apparatus in which an image recorded on a recording medium P is heated and pressed, and the image is fixed on the recording medium P, may be used.

According to the present invention, two types of test patterns are used to detect the density unevenness correction information for the respective characteristics, and, with the use of the third density unevenness correction information calculated based on the both pieces of density unevenness correction information detected, the image data is subjected to the density unevenness correction processing. As a result, the density unevenness can be corrected efficiently and accurately, enabling recording an image that has no or reduced image density unevenness.

In addition, by detecting the correction information separately in accordance with the characteristics, it is possible to reduce the amount of data processing and the cost on the apparatus.

What is claimed is:

1. An image recording method of recording an image on a recording medium while a recording head comprising a plurality of recording elements and the recording medium are moved relative to each other, the image recording method comprising:

a first recording characteristic information acquiring step of causing each of the recording elements of the recording head to eject the ink droplet, forming a first test pattern on the recording medium, reading the formed first test pattern, and acquiring first recording characteristic information of the recording element based on a result of the reading;

a first density unevenness correction information calculating step of obtaining first density unevenness correction information based on the first recording characteristic information;

a second recording characteristic information acquiring step of causing the each of the recording elements of the recording head to eject the ink droplet, forming a second test pattern different from the first test pattern on the recording medium, reading the second test pattern, and acquiring second recording characteristic information of the recording element based on a result of the reading;

a second density unevenness correction information calculating step of obtaining second density unevenness correction information based on the second recording characteristic information;

a third density unevenness correction information calculating step of obtaining third density unevenness correction information based on the first density unevenness correction information and the second density unevenness correction information;

a density correction processing step of correcting image data based on the third density unevenness correction information to calculate density unevenness-corrected image data; and an ejection control signal calculating step of calculating an ejection pattern of the recording element based on the unevenness-corrected image data.

2. The image recording method according to claim 1, wherein the second density unevenness correction information calculating step comprises calculating density unevenness having a lower frequency than a frequency of density unevenness calculated in the first density unevenness correction information calculating step.

3. The image recording method according to claim 1, wherein the first recording characteristic information comprises information at a position at which the ink droplet ejected from the each of the recording elements lands on the recording medium.

4. The image recording method according to claim 1, wherein the second density unevenness correction information acquiring step comprises creating the second test pattern based on the first density unevenness correction information.

5. The image recording method according to claim 1, wherein the second recording characteristic information acquiring step comprises acquiring the second density unevenness correction information at a higher frequency than a frequency at which the first density unevenness correction information is acquired in the first recording characteristic information acquiring step.

6. The image recording method according to claim 1, wherein:

the first recording characteristic information acquiring step comprises reading the first test pattern in a higher resolution than a resolution of a pixel recording density for recording the first test pattern; and the second recording characteristic information acquiring step comprises reading the second test pattern in a lower resolution than a resolution of the first recording characteristic information acquiring step.

7. The image recording method according to claim 1, wherein the first recording characteristic information acquiring step comprises reading the first test pattern in a resolution twice or more as high as a resolution of image data of the first test pattern.

8. The image recording method according to claim 1, wherein the first recording characteristic information and the second recording characteristic information each comprise density information for the each of the recording elements.

9. An image recording apparatus comprising:

a recording head comprising a plurality of recording elements for ejecting an ink droplet toward a recording medium;

movement means that causes the recording head and the recording medium to move relative to each other;

recording operation control means that records an image on the recording medium by causing the recording head to eject the ink droplet toward the recording medium while the recording head and the recording medium are moved relative to each other;

first test pattern reading means that reads a first test pattern formed on the recording medium by ejecting the ink droplet from each of the plurality of recording elements of the recording head;

first recording characteristic information acquiring means that acquires first recording characteristic information of the each of the plurality of recording elements based on a result of the reading of the first test pattern;

first density unevenness correction information calculating means that obtains first density unevenness correction information based on the first recording characteristic information;

second test pattern reading means that reads a second test pattern different from the first test pattern, which is formed on the recording medium by ejecting the ink droplet from the each of the plurality of recording elements of the recording head;

second recording characteristic information acquiring means that acquires second recording characteristic information of the each of the plurality of recording elements based on a result of the reading of the second test pattern;

second density unevenness correction information calculating means that obtains second density unevenness correction information based on the second recording characteristic information;

third density unevenness correction information calculating means that obtains third density unevenness correction information based on the first density unevenness correction information and the second density unevenness correction information;

density correction processing means that corrects image data based on the third density unevenness correction information to calculate density unevenness-corrected image data; and ejection pattern calculating means that calculates an ejection pattern of the each of the plurality of recording elements based on the unevenness-corrected image data.

10. The image recording apparatus according to claim 9, wherein:

the first density unevenness correction information calculating means calculates a position at which the ink droplet ejected from the each of the plurality of recording elements lands on the recording medium, to thereby calculate the first density unevenness correction information based on calculated landing position information; and the second density unevenness correction information calculating means detects, based on density variation of the second test pattern, density unevenness caused by variation in amount of the ink droplet ejected from the each of the plurality of recording elements, to thereby calculate the second density unevenness correction information based on the density unevenness caused by the variation in amount of the ink droplet ejected from the each of the plurality of recording elements.

11. The image recording apparatus according to claim 9, wherein the first test pattern reading means and the second test pattern reading means are configured as an identical means capable of switching between resolutions.

12. The image recording apparatus according to claim 9, wherein the first test pattern reading means and the second test pattern reading means are absent from a conveying path of the recording medium conveyed by the movement means.

13. The image recording apparatus according to claim 9, wherein the first test pattern reading means and the second test pattern reading means are arranged on the conveying path of the recording medium conveyed by the movement means.

14. The image recording apparatus according to claim 9, wherein:

the first test pattern reading means is absent from the conveying path of the recording medium conveyed by the movement means; and the second test pattern reading means is arranged on the conveying path of the recording medium conveyed by the movement means.

* * * * *